US010392212B2

(12) United States Patent
Mizuno

(10) Patent No.: US 10,392,212 B2
(45) Date of Patent: Aug. 27, 2019

(54) IMAGE FORMATION DEVICE

(71) Applicant: KONICA MINOLTA, INC., Chiyoda-ku, Tokyo (JP)

(72) Inventor: Kyoichi Mizuno, Tama (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 0 days.

(21) Appl. No.: 15/492,224

(22) Filed: Apr. 20, 2017

(65) Prior Publication Data

US 2017/0308022 A1 Oct. 26, 2017

(30) Foreign Application Priority Data

Apr. 21, 2016 (JP) ..... 2016-085511

(51) Int. Cl.

| | |
|---|---|
| ***B65H 5/22*** | (2006.01) |
| ***B65H 9/00*** | (2006.01) |
| ***B65H 9/20*** | (2006.01) |
| ***G03G 15/00*** | (2006.01) |

(52) U.S. Cl.

CPC ..... *B65H 5/22* (2013.01); *B65H 9/002* (2013.01); *B65H 9/008* (2013.01); *B65H 9/20* (2013.01); *G03G 15/6561* (2013.01); *B65H 2404/1424* (2013.01); *B65H 2406/3222* (2013.01); *B65H 2406/365* (2013.01); *G03G 2215/00679* (2013.01)

(58) Field of Classification Search

CPC ..... B65H 3/48; B65H 2301/331; B65H 2301/33; B65H 29/242; B65H 29/24; B65H 2404/1424; B65H 2406/3222; B65H 2406/365; B65H 5/22; B65H 9/002; B65H 9/008; B65H 9/20; G03G 2215/00679; G03G 15/6561

See application file for complete search history.

(56) References Cited

U.S. PATENT DOCUMENTS 5,557,387 A * 9/1996 Hatano ..... B65H 3/126 271/11
8,276,905 B2 * 10/2012 Suzuki ..... B65H 1/14 271/104
8,439,348 B2 * 5/2013 Suzuki ..... B65H 3/128 271/96

(Continued)

FOREIGN PATENT DOCUMENTS

JP 5-124752 A 5/1993

*Primary Examiner* — David H Banh

(74) *Attorney, Agent, or Firm* — Buchanan Ingersoll & Rooney PC

(57) ABSTRACT

An image formation device includes: a registration roller pair configured to shift sheet in a second direction perpendicular to a first direction of a sheet feeding direction while holding the sheet; a feeding section provided upstream of the registration roller pair in the first direction and including a feeding belt configured to convey the sheet to the registration roller pair; a first air adjustment section configured to perform air suction or blowing for the sheet conveyed by the feeding belt; and a control section configured to switch between a first operation of controlling, when the sheet is conveyed by the feeding belt, the first air adjustment section to suck the sheet with air and a second operation of controlling, when the sheet is swung by the registration roller pair, the first air adjustment section to blow air on the sheet.

17 Claims, 9 Drawing Sheets

(56) References Cited

U.S. PATENT DOCUMENTS 8,714,542 B2 * 5/2014 Tsuji ..... B65H 3/46 271/105
2005/0242493 A1 * 11/2005 Agata ..... B65H 5/062 271/226
2006/0170149 A1 * 8/2006 Seto ..... B65H 9/04 271/240
2008/0038004 A1 * 2/2008 Inoue ..... G03G 15/6564 399/394
2008/0044213 A1 * 2/2008 Kato ..... G03G 15/6573 399/405
2010/0034569 A1 * 2/2010 Moteki ..... G03G 15/2021 399/341
2010/0264577 A1 * 10/2010 Suzuki ..... B65H 3/128 271/11
2011/0140344 A1 * 6/2011 Suzuki ..... B65H 1/14 271/3.22
2011/0163491 A1 * 7/2011 Suzuki ..... B65H 3/128 271/5
2012/0074639 A1 * 3/2012 Suzuki ..... B65H 3/128 271/5
2012/0133092 A1 * 5/2012 Fuda ..... B65H 3/128 271/104
2012/0153559 A1 * 6/2012 Ubayashi ..... B65H 3/128 271/12
2012/0207485 A1 * 8/2012 Iwakawa ..... G03G 15/0189 399/16
2013/0200563 A1 * 8/2013 Clevers ..... B65H 5/224 271/7
2015/0021848 A1 * 1/2015 Mizuno ..... B65H 3/48 271/12
2015/0029525 A1 * 1/2015 Shimoyama ..... B65H 3/128 358/1.12
2015/0062273 A1 * 3/2015 Ando ..... B41J 11/0045 347/104
2015/0338813 A1 * 11/2015 Deno ..... G03G 15/043 399/395
2016/0004216 A1 * 1/2016 Hatanaka ..... G03G 21/206 399/92

* cited by examiner

IMAGE FORMATION DEVICE

The entire disclosure of Japanese Patent Application No. 2016-085511 filed on Apr. 21, 2016 including description, claims, drawings, and abstract are incorporated herein by reference in its entirety.

BACKGROUND OF THE INVENTION

Field of the Invention

The present invention relates to an image formation device.

Description of the Related Art

Typically, an image formation device employing an electrophotographic technique, such as a printer and a copy machine, has been widely used. In the typical image formation device, sheet might be conveyed while leaning in a direction perpendicular to a feeding direction (hereinafter referred to as a "sheet width direction") due to, for example, various types and characteristics of sheet to be used, characteristics of a component such as a feeding roller, and use environment such as a temperature and a humidity in feeding. When printing processing is executed in this state, there is a problem that a printing position accuracy is lowered.

For this reason, so-called leaning correction (registration shift correction) has been typically performed. In the leaning correction, based on a detection result of a sheet displacement in the width direction by a leaning sensor, sheet is moved in the sheet width direction while being held by a registration roller pair, and in this manner, a position relationship between the sheet and an image is adjusted. For example, JP 05-124752 A relates to a sheet alignment device for sheet registration, and describes that not only do registration rollers perform sheet alignment, but also pre-registration rollers arranged upstream of the registration rollers have an alignment function.

However, there are the following problems with, for example, the typical image formation device described in JP 05-124752 A. That is, since both of the registration rollers and the pre-registration rollers are swung, friction among the pre-registration rollers and the sheet does not occur in shift, but friction between a guide plate and the sheet occurs. As a result, an image quality is lowered. In this case, there is also another problem that a shift accuracy is lowered due to resistance in sheet shift. Further, there is still another problem that, when the amount of shift is different even slightly among the registration rollers and the pre-registration rollers in sheet shift, stress is applied to the sheet, and sheet wrinkling occurs.

SUMMARY OF THE INVENTION

An object of the present invention is to provide an image formation device capable of reliably preventing lowering of an image quality when registration shift correction is performed by a registration roller pair.

To achieve the abovementioned object, according to an aspect, an image formation device reflecting one aspect of the present invention comprises: a registration roller pair configured to shift sheet in a second direction perpendicular to a first direction of a sheet feeding direction while holding the sheet; a feeding section provided upstream of the registration roller pair in the first direction and including a feeding belt configured to convey the sheet to the registration roller pair; a first air adjustment section configured to perform air suction or blowing for the sheet conveyed by the feeding belt; and a control section configured to switch between a first operation of controlling, when the sheet is conveyed by the feeding belt, the first air adjustment section to suck the sheet with air and a second operation of controlling, when the sheet is swung by the registration roller pair, the first air adjustment section to blow air on the sheet.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Figure 1:
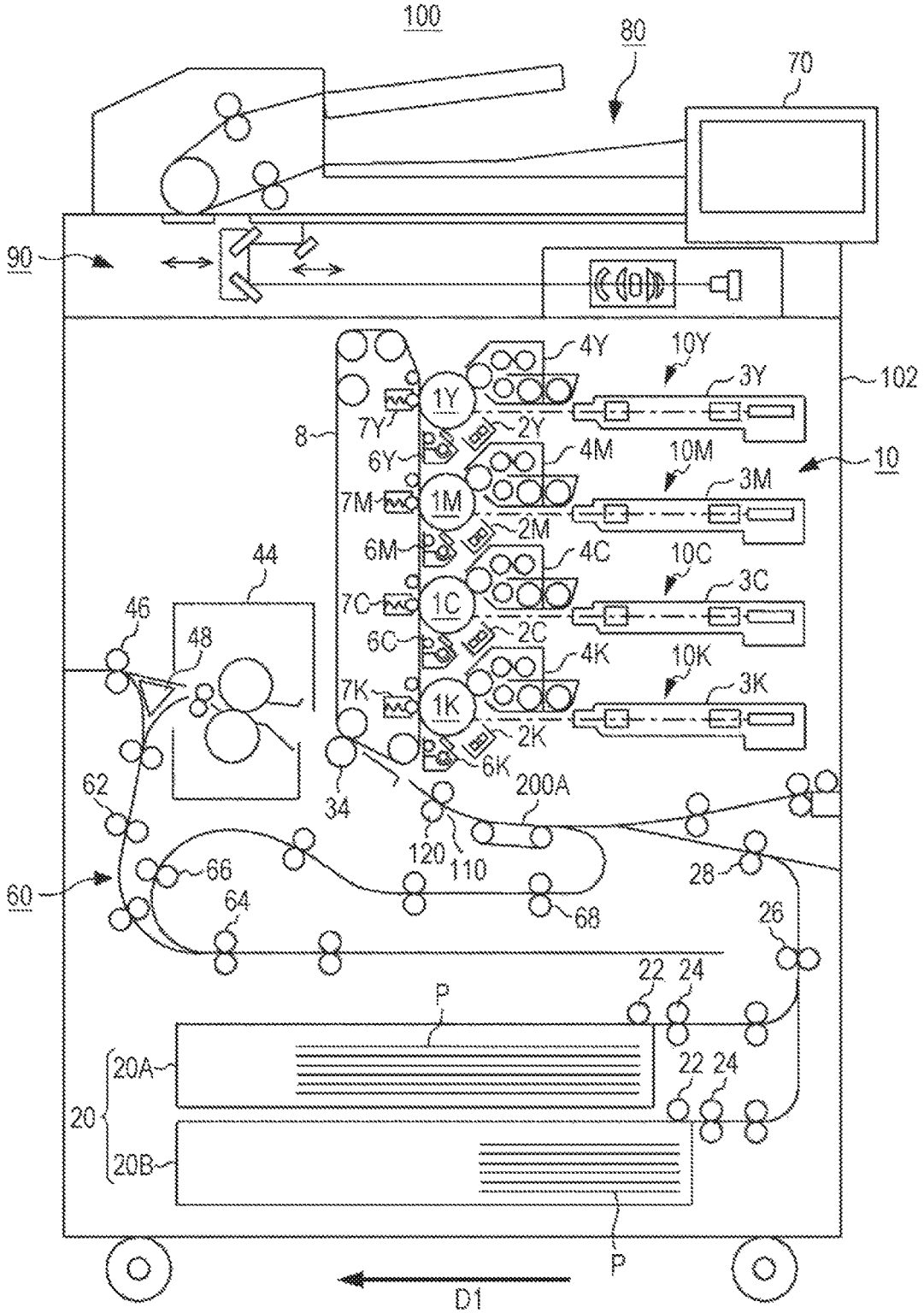
FIG. 1 is a view of a configuration example of an image formation device according to an embodiment of the present invention.

Hereinafter, preferred embodiments of the present invention will be described in detail with reference to the drawings. However, the scope of the invention is not limited to the illustrated examples. Note that a dimension ratio in the drawings is exaggerated for the sake of description, and might be different from an actual ratio.

First Embodiment

[Configuration Example of Image Formation Device 100]

FIG. 1 illustrates an example of a configuration of an image formation device 100 of the present invention. As illustrated in FIG. 1, the image formation device 100 is a so-called tandem image formation device, and includes an automatic document feeding section 80 and a device body 102. The automatic document feeding section 80 is attached to an upper portion of the device body 102 to send sheet to an image reading section 90 of the device body 102 by, for example, feeding rollers, the sheet being set on a feeding table.

The device body 102 includes an operation display section 70, the image reading section 90, an image formation section 10, an intermediate transfer belt 8, a sheet feeding section 20, a feeding section 200A, a registration section 110, a fixing section 44, and an automatic sheet inversion feeding unit 60 (an auto duplex unit, hereinafter referred to as an "ADU").

The operation display section 70 includes a touch panel having a combination of a display section and an input section, and a plurality of operation keys including a start key and an enter key provided at a peripheral portion of the touch panel. The operation display section 70 is configured to display an operation screen and the like on a display screen and to receive information such as an image formation condition input by touch operation on the operation screen or operation of the operation keys.

The image reading section 90 is configured to use an optical system of a scanning exposure device to perform scanning exposure of a document placed on a document table or a document conveyed by the automatic document feeding section 80, thereby photoelectrically converting an image of the scanned document by a charge coupled device (CCD) image sensor to generate an image information signal. The image information signal is output to the image formation section 10 after analog processing, analog/digital (hereinafter referred to as "A/D") conversion processing, shading correction, image compression processing, and the like by a not-shown image processing section.

The image formation section 10 is configured to form an image by an electrophotographic technique. The image formation section 10 includes an image formation unit 10Y configured to form an image in a color of yellow (Y), an image formation unit 10M configured to form an image in a color of magenta (M), an image formation unit 10C configured to form an image in a color of cyan (C), and an image formation unit 10K configured to form an image in a color of black (K). In this example, a common functional name such as a reference numeral "10" is followed by Y, M, C, or K indicating an image formation color.

The image formation unit 10Y includes a photosensitive drum 1Y, a charger 2Y disposed at the periphery of the photosensitive drum 1Y, an exposure section (an optical writing section) 3Y, a developer 4Y, and a cleaning section 6Y. The image formation unit 10M includes a photosensitive drum 1M, a charger 2M disposed at the periphery of the photosensitive drum 1M, an exposure section 3M, a developer 4M, and a cleaning section 6M. The image formation unit 10C includes a photosensitive drum 1C, a charger 2C disposed at the periphery of the photosensitive drum 1C, an exposure section 3C, a developer 4C, and a cleaning section 6C. The image formation unit 10K includes a photosensitive drum 1K, a charger 2K disposed at the periphery of the photosensitive drum 1K, an exposure section 3K, a developer 4K, and a cleaning section 6K.

The photosensitive drums (image carriers) 1Y, 1M, 1C, 1K, the chargers 2Y, 2M, 2C, 2K, the exposure sections 3Y, 3M, 3C, 3K, the developers 4Y, 4M, 4C, 4K, the cleaning sections 6Y, 6M, 6C, 6K, and primary transfer rollers 7Y, 7M, 7C, 7K in the image formation units 10Y, 10M, 10C, 10K have common configurations. These components will be hereinafter described without Y, M, C, K, except for the case where these components need to be particularly distinguished from each other.

The charger 2 is configured to substantially uniformly charge a surface of the photosensitive drum 1. The exposure section 3 includes, for example, a LED print head (LPH) having a LED array and an imaging lens, or a polygon mirror type laser exposure scanning device. The exposure section 3 is configured to use a laser light to scan the photosensitive drum 1 based on the image information signal, thereby forming an electrostatic latent image. The developer 4 is configured to develop, using toner, the electrostatic latent image formed on the photosensitive drum 1. With this configuration, a toner image as a visible image is formed on the photosensitive drum 1.

The intermediate transfer belt 8 is rotatably supported while being stretched on a plurality of rollers. With rotation of the intermediate transfer belt 8, the primary transfer roller 7 and the photosensitive drum 1 rotate, and a predetermined voltage is applied to between the primary transfer roller 7 and the photosensitive drum 1. Accordingly, the toner image formed on the photosensitive drum 1 is transferred onto the intermediate transfer belt 8 (primary transferring).

The sheet feeding section 20 includes a plurality of sheet feeding trays 20A, 20B housing, for example, documents of sheet P with A3 and A4 sizes. The sheet P conveyed from each of the sheet feeding trays 20A, 20B by feeding rollers 22, 24, 26, 28 and the like is conveyed to the feeding section 200A and the registration section 110. Note that the number of sheet feeding trays is not limited to two. If necessary, one or more large-capacity sheet feeding devices configured to house a great volume of sheet P may be coupled together.

The sheet P conveyed to the registration section 110 comes into contact with a registration roller pair 120 by feeding using the feeding section 200A, and as a result, curvature of the sheet P is corrected. The sheet P of which the curvature has been corrected is conveyed to a secondary transfer section 34 at predetermined timing. In the secondary transfer section 34, the toner images transferred in the colors of Y, M, C, and K onto the intermediate transfer belt 8 are collectively transferred onto a surface of the sheet P conveyed by the registration roller pair 120 (secondary transferring). The secondary-transferred sheet P is conveyed to the fixing section 44 on a downstream side in a sheet feeding direction D1.

The fixing section 44 includes a pressurization roller and a heating roller. The fixing section 44 performs pressurizing and heating processing for the sheet P onto which the toner images have been transferred in the secondary transfer section 34, thereby fixing the toner images onto the surface of the sheet P.

A feeding path switch section 48 is provided downstream of the fixing section 44 in the sheet feeding direction D1, and is configured to perform the control of switching a feeding path based on a selected printing mode (a one-side printing mode, a duplex printing mode, and the like). The sheet P subjected to one-side printing in the one-side printing mode or the sheet P subjected to duplex printing in the duplex printing mode is discharged onto a sheet discharge tray by sheet discharge rollers 46.

In the case of forming an image on a back side of the sheet P in the duplex printing mode, the sheet P with an image formed on a front side of the sheet P is conveyed to the ADU 60 via feeding rollers 62 and the like. In a switch back path of the ADU 60, a back end of the sheet P is, as a leading end, conveyed to a U-turn path section by inverse rotation control of ADU rollers 64, and then, is re-fed to the secondary transfer section 34 in the state in which the sheet P is inverted upside down by, for example, feeding rollers 66, 68 provided at the U-turn path section.

[Configuration Examples of Registration Section 110 and Feeding Section 200A]

Figure 2:
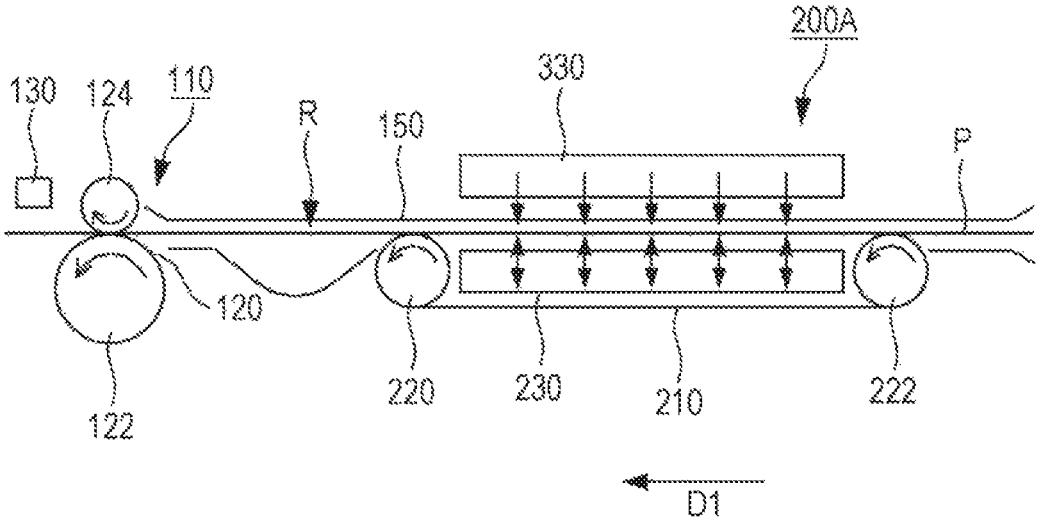
FIG. 2 is a view of configuration examples of a registration section and a feeding section according to a first embodiment of the present invention.
Figure 3:
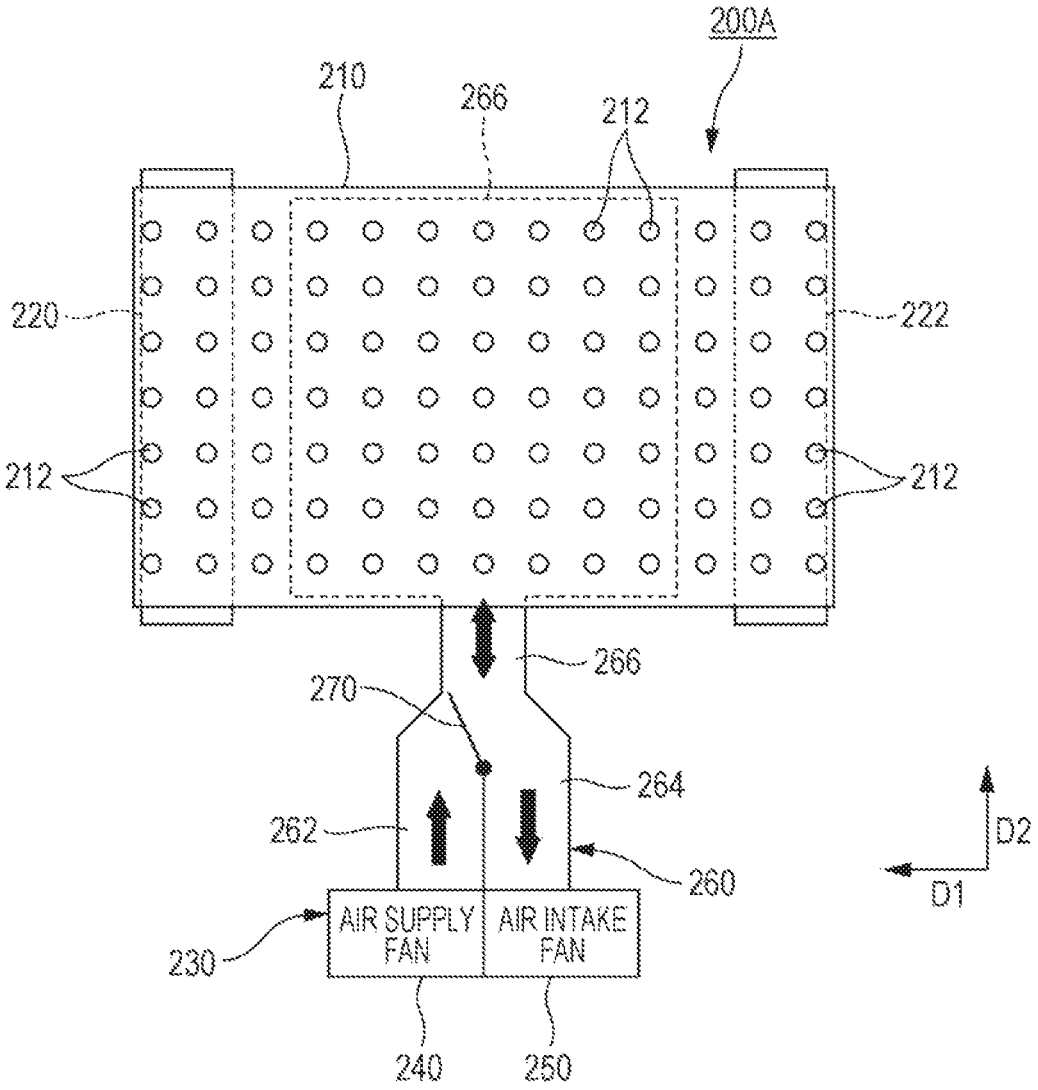
FIG. 3 is a view of a configuration example of a feeding section provided on a lower side of a feeding path.
Figure 4:
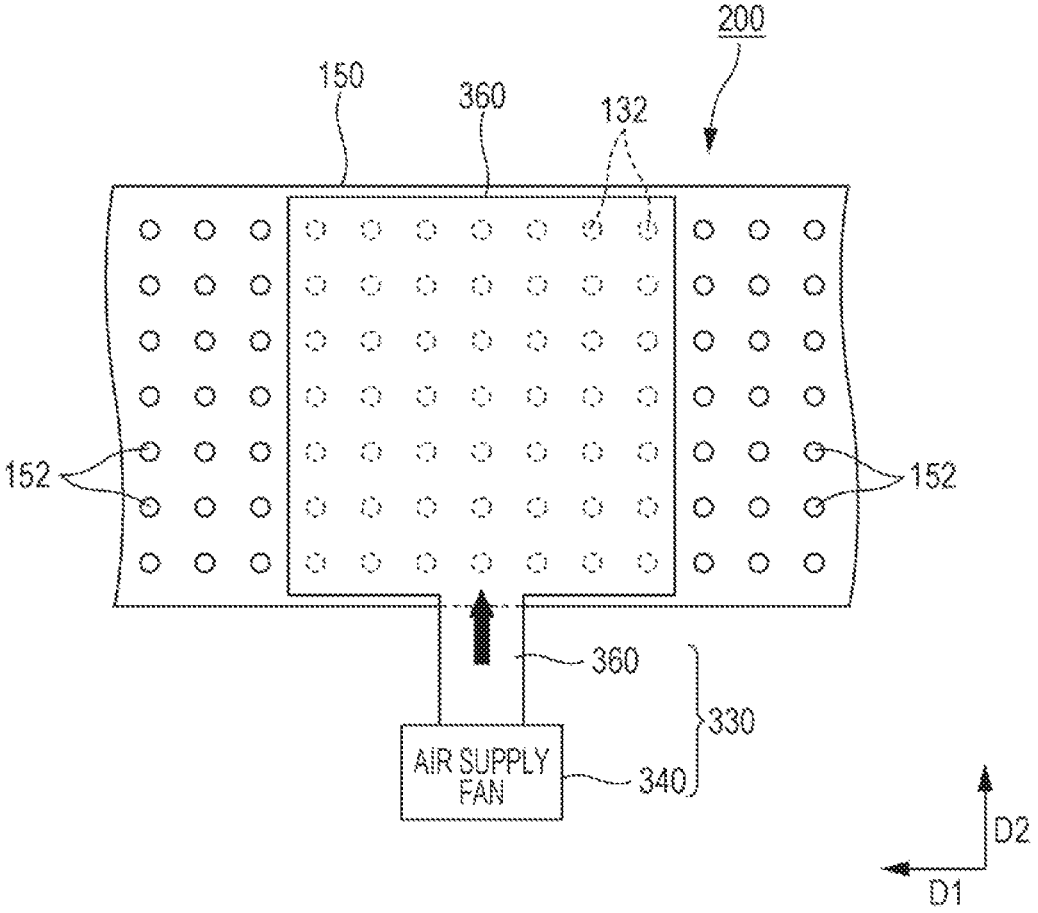
FIG. 4 is a view of a configuration example of a feeding section provided on an upper side of the feeding path.

FIG. 2 is a side view of an example of configurations of the registration section 110 and the feeding section 200A according to the first embodiment. FIG. 3 is a plan view of an example of the configuration of the feeding section 200A on a lower side of a feeding path R. FIG. 4 is a plan view of the example of the configuration of the feeding section 200A on an upper side of the feeding path R.

As illustrated in FIG. 2, the registration section 110 includes the registration roller pair 120 and a leaning detection sensor 130. The registration roller pair 120 is disposed upstream of the secondary transfer section 34 in the sheet feeding direction D1. The registration roller pair 120 is configured to create a loop by contact of a tip end of the sheet P to correct curvature of the sheet P, to correct alignment between the sheet tip end and an image tip end after sheet re-feeding, and to shift the sheet P in a sheet width direction D2 with the sheet P being held by the registration roller pair 120 to correct leaning of the sheet P. The registration roller pair 120 includes a rotatably-drivable drive roller 122 and a rotatably-driven driven roller 124.

The leaning detection sensor 130 is disposed downstream of the registration roller pair 120 in the sheet feeding direction D1. The leaning detection sensor 130 may include a line sensor configured such that a plurality of photoelectric conversion elements are arranged linearly along the sheet width direction D2, or an image sensor configured such that a plurality of photoelectric conversion elements are arranged in a matrix. A CCD image sensor or a CMOS (including a MOS type) image sensor can be used as the line sensor and the image sensor.

The feeding section 200A is disposed upstream of the registration section 110 in the sheet feeding direction D1. The feeding section 200A includes feeding rollers 220, 222, a feeding belt 210, and air adjustment sections 230, 330. The feeding rollers 220, 222 are arranged on the lower side of the feeding path R with a certain spacing. In the present embodiment, at least one of the feeding roller 220 or the feeding roller 222 is a drive roller.

The feeding belt 210 is an endless belt member, and is stretched on the feeding rollers 220, 222. The feeding belt 210 rotates with rotation of the feeding roller 220 to convey the sheet P in the sheet feeding direction D1. The feeding belt 210 is provided with many through-holes 212 for air blowing and air suction (see FIG. 3). Each through-hole 212 is in a circular shape as viewed in the plane, for example.

As illustrated in FIG. 3, the air adjustment section 230 is configured to adjust the state of air from the lower side of the feeding path R on the sheet P. The air adjustment section 230 includes an air supply fan 240, an air intake fan 250, and a duct 260. The air supply fan 240 is configured to blow air through the through-holes 212 of the feeding belt 210 to convey the sheet P with the sheet P floating above the feeding belt 210. The air intake fan 250 is configured to suck air through the through-holes 212 of the feeding belt 210 to convey the sheet P with the sheet P sticking to the feeding belt 210.

The duct 260 includes an air supply duct 262, an air intake duct 264, and a common duct 266. One end portion of the air supply duct 262 is connected to the air supply fan 240, and the other end portion of the air supply duct 262 is connected to the common duct 266. One end portion of the air intake duct 264 is connected to the air intake fan 250, and the other end portion of the air intake duct 264 is connected to the common duct 266. One end portion of the common duct 266 is connected to each of the air supply duct 262 and the air intake duct 264, and the other end portion of the common duct 266 extends to the inside of the feeding belt 210. The common duct 266 opens at the other end portion thereof, and such an opening is formed facing the feeding belt 210 positioned above.

An air path switch member 270 is provided at a boundary between the air supply duct 262 and the air intake duct 264, and is configured to open or close, according to the state of processing of the sheet P, an air path of each of the air supply duct 262 and the air intake duct 264. For example, a solenoid can be used for driving of the air path switch member 270.

As illustrated in FIGS. 2 and 4, the air adjustment section 330 is provided facing the air adjustment section 230 with the feeding path R being interposed therebetween (i.e., provided on the opposite side of the feeding path R from the air adjustment section 230), and is configured to adjust the state of air from the upper side of the feeding path R on the sheet P. The air adjustment section 330 includes an air supply fan 340 and a duct 360. The air supply fan 340 is configured to blow air from above the sheet P to bias the sheet P toward the feeding belt 210. With this configuration, the sheet P is conveyed with the sheet P being maintained at a certain height when the sheet P floats by air from the lower side of the feeding path R, and is reliably conveyed with the sheet P sticking to the feeding belt 210 when the sheet P is sucked onto the feeding belt 210.

One end portion of the duct 360 is connected to the air supply fan 340, and the other end portion of the duct 360 extends to a position corresponding to the feeding belt 210 above a guide member 150. The duct 360 opens at the other end portion thereof, and such an opening is formed facing the guide member 150 provided below. As in the above-described feeding belt 210, the guide member 150 is provided with many through-holes 152 for air blowing. Each through-hole 152 is in a circular shape as viewed in the plane, for example.

[Block Configuration Example of Image Formation Device 100]

Figure 5:
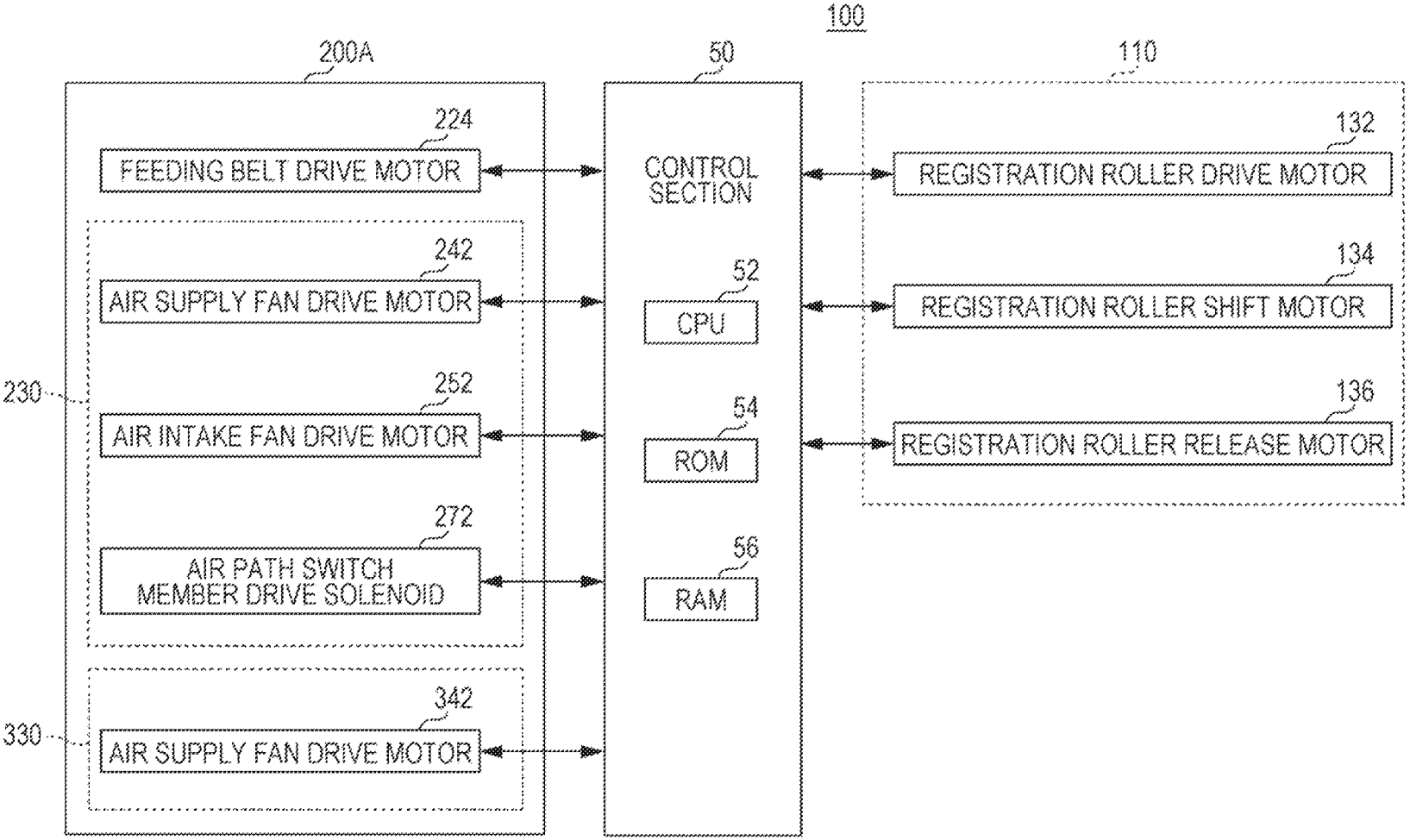
FIG. 5 is a block diagram of a functional configuration example of the image formation device.

FIG. 5 is a block diagram of an example of a functional configuration of the image formation device 100. As illustrated in FIG. 5, the image formation device 100 includes a control section 50 configured to control operation of the entirety of the device. The control section 50 includes a central processing unit (CPU) 52, a read only memory (ROM) 54, and a random access memory (RAM) 56. The CPU 52 is configured to execute software (a program) read from the ROM 54 to control each section of the image formation device 100, thereby implementing image formation processing functions including adjustment of air provided to the sheet P in feeding thereof.

Each of the following sections is connected to the control section 50: a registration roller drive motor 132; a registration roller shift motor 134; a registration roller release motor 136; a feeding belt drive motor 224; an air supply fan drive motor 242; an air intake fan drive motor 252; an air path switch member drive solenoid 272; an air supply fan drive motor 342.

The registration roller drive motor 132 is configured to drive based on a drive signal supplied from the control section 50, thereby rotatably driving the registration roller pair 120. The registration roller shift motor 134 is configured to drive based on a drive signal supplied from the control section 50 to operate a rack, a pinion gear, and the like, thereby moving the registration roller pair 120 in the sheet width direction D2.

The registration roller release motor 136 is configured to drive based on a drive signal supplied from the control section 50 to operate a cam and the like, thereby pressing or releasing the registration roller pair 120. The feeding belt drive motor 224 is configured to drive based on a drive signal supplied from the control section 50, thereby rotating the feeding belt 210 via the feeding roller 220.

The air supply fan drive motor 242 is configured to drive based on a drive signal supplied from the control section 50, thereby actuating the air supply fan 240 on the lower side of the feeding path R to blow air. The air intake fan drive motor 252 is configured to drive based on a drive signal supplied from the control section 50, thereby actuating the air intake fan 250 on the lower side of the feeding path R to suck air.

The air path switch member drive solenoid 272 is configured to drive based on a drive signal supplied from the control section 50, thereby opening or closing each of the air supply duct 262 and the air intake duct 264.

The air supply fan drive motor 342 is configured to drive based on a drive signal supplied from the control section 50, thereby actuating the air supply fan 340 on the upper side of the feeding path R to blow air.

[Operation Example of Image Formation Device 100]

Figure 6:
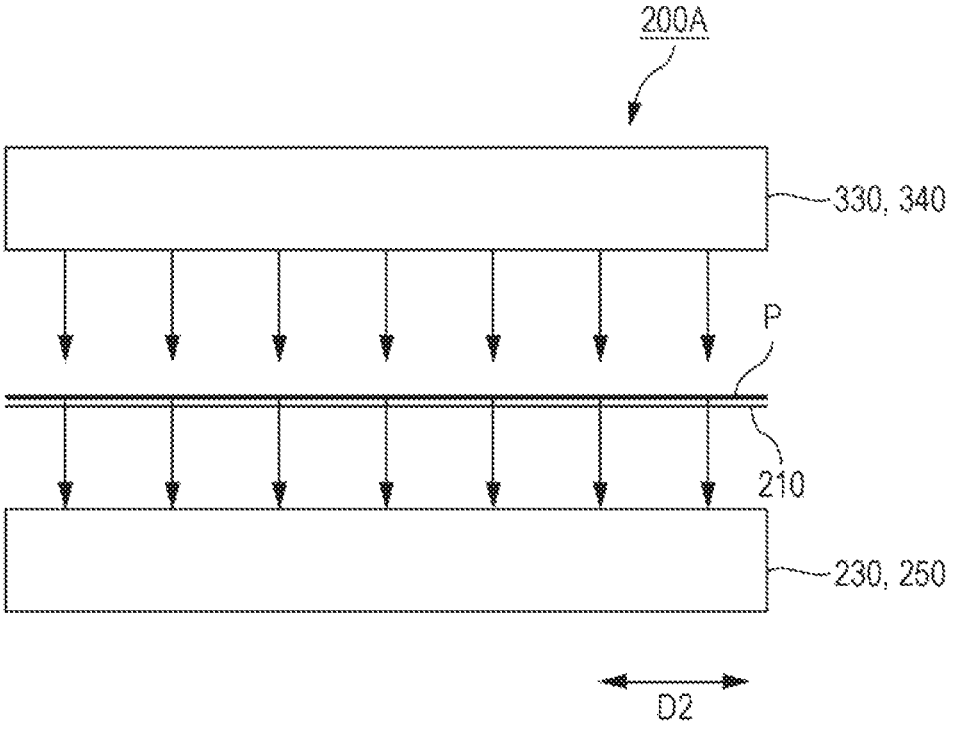
FIG. 6 is a view of the state of air provided to sheet in normal sheet feeding.
Figure 7:
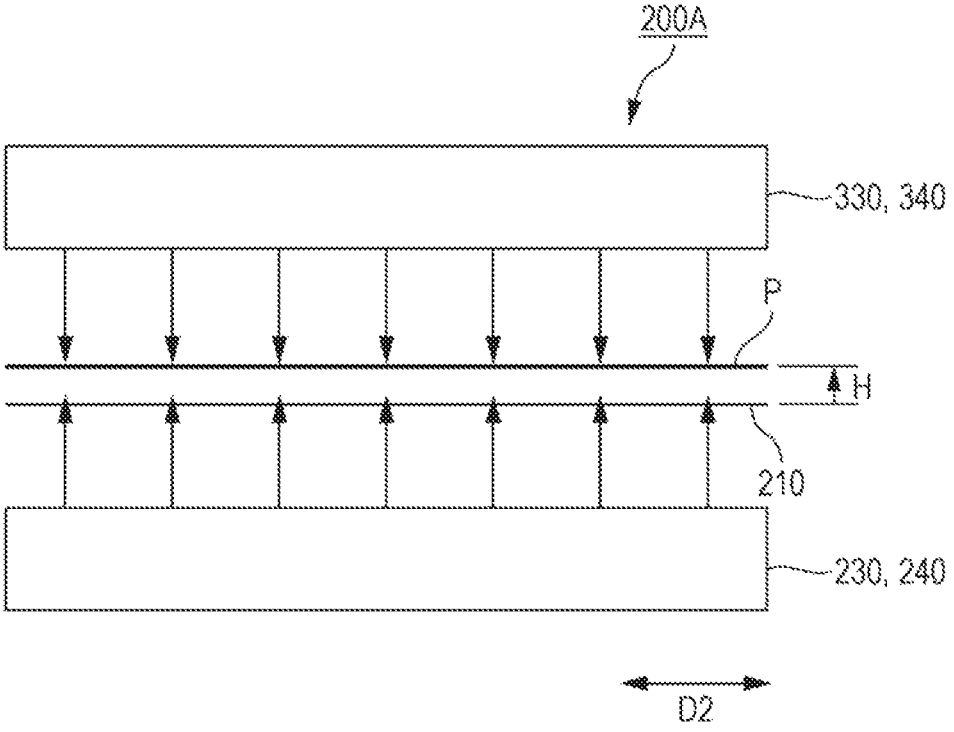
FIG. 7 is a view of the state of air provided to sheet in registration shift correction.

FIG. 6 is a view of the state of air provided to the sheet P in normal feeding control of the sheet P. FIG. 7 is a view of the state of air provided to the sheet P in registration shift correction. Note that FIGS. 6 and 7 are schematic views when the feeding section 200A on the downstream side is viewed from the sheet feeding direction D1.

When an external device such as a computer transmits a job, sheet P specified based on an image formation condition contained in the job is taken out of the sheet feeding section 20, and then, the taken sheet P is conveyed to the feeding section 200A via the feeding rollers 22, 24, and the like.

The control section 50 controls the air path switch member drive solenoid 272 to open the air path of the air intake duct 264 and to close the air supply duct 262.

Upon the start of the job, the control section 50 drives the feeding belt drive motor 224 to rotate the feeding belt 210. Moreover, the control section 50 drives the air intake fan drive motor 252 on the lower side, thereby causing the air intake fan 250 to suck air. In addition, the control section 50 drives the air supply fan drive motor 342 on the upper side, thereby causing the air supply fan 340 to blow air (first operation).

In this manner, the sheet P sticks, as illustrated in FIG. 6, to the feeding belt 210 by air suction from the air intake fan 250 disposed on the lower side of the feeding path R, and is biased toward the feeding belt 210 by air blowing from the air supply fan 340 disposed on the upper side of the feeding path R. In this state, the sheet P is conveyed in the sheet feeding direction D1.

When a not-shown sensor detects a tip end portion of the sheet P, the control section 50 inversely rotates the registration roller pair 120. The sheet P conveyed by the feeding belt 210 comes into contact with the inversely-rotating registration roller pair 120, thereby forming a loop. As a result, curvature of the sheet P is corrected.

Upon completion of curvature correction of the sheet P, the control section 50 switches the registration roller pair 120 to normal rotation, thereby starting re-feeding of the sheet P. In re-feeding of the sheet P, the leaning detection sensor 130 (see FIG. 2) detects the end portion position of the sheet P in the sheet width direction D2. The control section 50 obtains, from the leaning detection sensor 130, the end portion position of the sheet P in the sheet width direction D2, and then, calculates a leaning amount (a shift command value) of the sheet P in the sheet width direction D2 based on the obtained end portion position.

The control section 50 drives the registration roller shift motor 134 based on the calculated shift command value, thereby shifting the registration roller pair 120 in the sheet width direction D2. Moreover, the control section 50 controls, before or upon the start of registration shift correction, the air path switch member drive solenoid 272 to close the air path of the air intake duct 264 and to open the air supply duct 262. Further, the air supply fan drive motor 242 on the lower side is driven such that the air supply fan 240 blows air. In this state, the feeding belt 210 rotates in the sheet feeding direction D1 with the drive state of the feeding belt drive motor 224 being maintained, and driving of the air supply fan drive motor 342 on the upper side is also maintained (second operation). As described above, the control section 50 switches the method for supplying air to the sheet P in registration shift correction from the first operation to the second operation.

With this configuration, the sheet P floats, as illustrated in FIG. 7, from the feeding belt 210 by air blowing from the air supply fan 240 disposed on the lower side of the feeding path R, and is maintained at a certain height H by air blowing from the air supply fan 340 disposed on the upper side of the feeding path R. In this state, the sheet P is conveyed in the sheet feeding direction D1.

As described above, according to the first embodiment, the floating sheet P is swung by the registration roller pair 120 in registration shift correction, and therefore, friction of the sheet P with the guide member 150 and the feeding belt 210 can be prevented. This can prevent lowering of an image quality. Moreover, according to the first embodiment, friction resistance between the sheet P and each of the guide member 150 and the feeding belt 210 can be reduced in registration shift correction. Thus, the drive torque of the registration roller shift motor 134 and the force of holding sheet on the registration roller pair 120 can be reduced.

Further, according the first embodiment, not a typical loop roller but the feeding belt 210 forms a sheet feeding mechanism. Thus, the operation of shifting the rollers upstream of the registration roller pair 120 and the operation of releasing a nip can be omitted. As a result, registration shift correction can be implemented with a simple inexpensive configuration.

Second Embodiment

A second embodiment is different from the above-described first embodiment in that the amount of air blown from an air supply fan 240 is adjusted according to a shift direction of sheet P in registration shift correction. Note that other configurations, functions, and the like of an image formation device 100 are similar to those of the image formation device 100 described in the first embodiment. Thus, the same reference numerals are used to represent equivalent elements, and description thereof will not be repeated.

[Configuration Example of Feeding Section 200B]

Figure 8:
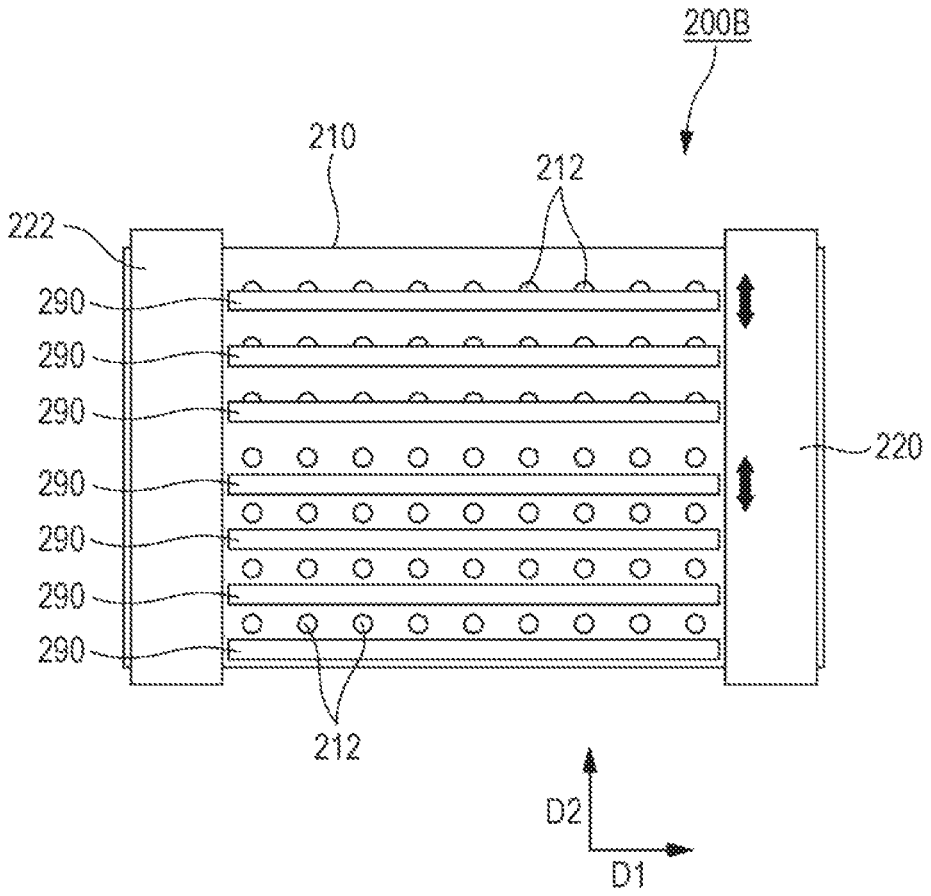
FIG. 8 is a view of a configuration example of a feeding section according to a second embodiment of the present invention.

FIG. 8 illustrates an example of a configuration when the inside of a feeding belt 210 of a feeding section 200B of the second embodiment is viewed from above.

As illustrated in FIG. 8, the feeding section 200B includes air volume adjustment members 290 in addition to the feeding belt 210, feeding rollers 220, 222, and air adjustment sections 230, 330 as described above.

Each air volume adjustment member 290 is a member configured to adjust the aperture ratio (the percentage of air passage) of each through-hole 212 formed at the feeding belt 210. Each air volume adjustment member 290 is a band-shaped member extending in a sheet feeding direction D1, and is provided at a position corresponding to a position between adjacent ones of lines of the through-holes 212 arranged in lines. Moreover, each air volume adjustment member 290 is connected to a not-shown drive section, and is movable in a sheet width direction D2 within a predetermined area by driving of the drive section. The predetermined area is, for example, an area from a position at which all of the through-holes 212 open to a position at which all of the through-holes 212 are closed. The amount of movement of each air volume adjustment member 290 is optionally set according to a target volume of air to be blown through the through-holes 212.

Note that the air volume adjustment member 290 for air blown from a lower side of a feeding path R has been described above as an example, but a configuration similar to that of the air volume adjustment member 290 can be employed for adjustment of the volume of air blown from an upper side of the feeding path R. Specifically, a guide member 150 on the upper side of the feeding path R is provided with an adjustment member configured to adjust the aperture ratio of each through-hole 152 so that the volume of air blown from the air adjustment section 330 can be adjusted.

[Operation Example of Feeding Section 200B]

Figure 9:
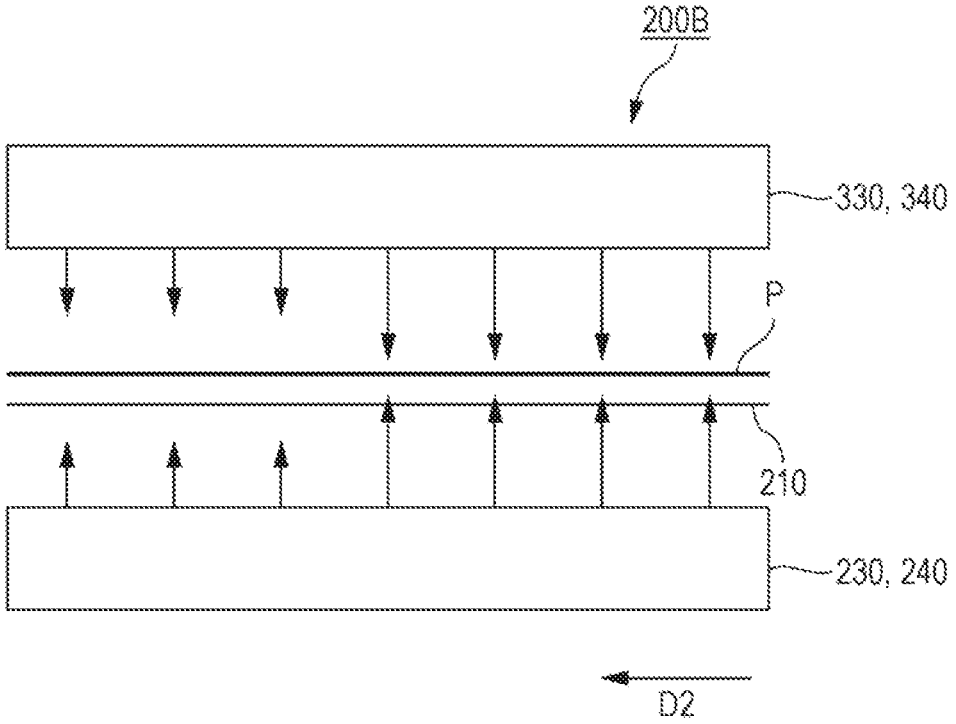
FIG. 9 is a view of the state of air provided to sheet in registration shift correction.

FIG. 9 is a view of the state of air provided to the sheet P in registration shift correction according to the second embodiment. Note that FIG. 9 is a schematic view when the feeding section 200B on an upstream side is viewed from the sheet feeding direction D1. Moreover, as viewed in FIG. 9, the left side is referred to as a "far side" (hereinafter referred to as a "device far side") of the image formation device 100, and the right side is referred to as a "near side" (hereinafter referred to as a "device near side") of the image formation device 100.

When a leaning detection sensor 130 detects an end portion position of the sheet P after curvature correction of the sheet P, a control section 50 obtains, based on such a detection result, a shift direction of the sheet P in the sheet width direction D2. Specifically, information on a device near side direction or a device far side direction of the sheet width direction D2 is obtained. When the shift direction in registration shift correction is the device far side direction, the control section 50 moves the air volume adjustment members 290 to close, for example, a substantially half of the area of the through-holes 212 of the first to third lines from the upper side of the FIG. 8 on the device far side. Moreover, the control section 50 moves the air volume adjustment members 290 to open, for example, all of the through-holes 212 of the first to fourth lines from the lower side of the FIG. 8 on the device near side.

With this configuration, the air supply fans 240, 340 blow a great volume of air to each surface of the sheet P on the device near side, and blow a small volume of air to each surface of the sheet P on the device far side, as illustrated in FIG. 9. Thus, the sheet P is conveyed in the sheet feeding direction D1 with the sheet P floating at a certain height.

In the case where the shift direction in registration shift correction is the device near side direction, the air volume is adjusted by control opposite to the method described above. Specifically, operation of each air volume adjustment member 290 is controlled such that a small volume of air is blown from each through-hole 212 positioned on the device near side and that a great volume of air is blown from each through-hole 212 positioned on the device far side.

As described above, according to the second embodiment, the volume of air to be blown is set greater on the opposite side of the registration shift direction, and therefore, shift of the sheet P can be assisted. That is, the side of the sheet P opposite to the shift direction is pushed hard by air so that the sheet P can be biased to the shift direction. With this configuration, registration shift correction can be reliably implemented with a high accuracy.

Third Embodiment

A third embodiment is different from the above-described first and second embodiments in that the direction of air blown from an air supply fan 240 and the like is adjusted according to a shift direction in registration shift correction. Note that other configurations, functions, and the like of an image formation device 100 are similar to those of the image formation device 100 described in the first embodiment. Thus, the same reference numerals are used to represent equivalent elements, and description thereof will not be repeated.

[Configuration Example of Feeding Section 200C]

Figure 10:
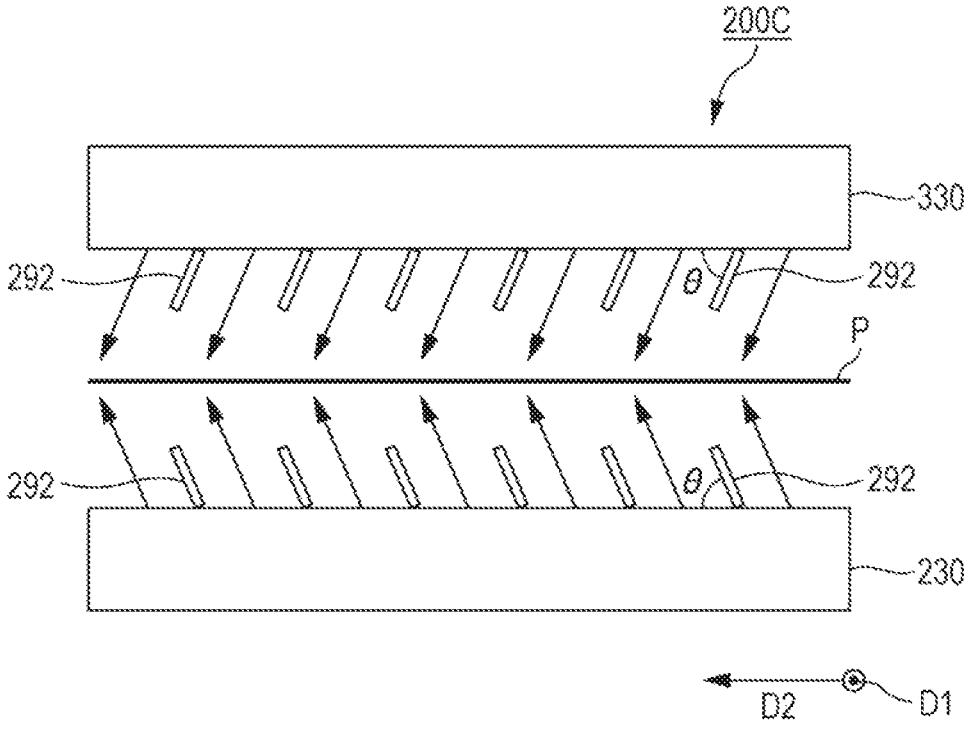
FIG. 10 is a view of a configuration example of a feeding section according to a third embodiment of the present invention.

FIG. 10 illustrates an example of a configuration of a feeding section 200C of the third embodiment. Note that as viewed in FIG. 10, the left side is referred to as a "device far side," and the right side is referred to as a "device near side." As illustrated in FIG. 10, the feeding section 200C includes air direction adjustment members (louvers) 292 in addition to a feeding belt 210, feeding rollers 220, 222, and air adjustment sections 230, 330 as described above.

Each air direction adjustment member 292 is a member configured to adjust the direction of air blown from through-holes 212 of the feeding belt 210. Each air direction adjustment member 292 is a band-shaped member extending in a sheet feeding direction D1, and is provided at a position corresponding to a position between adjacent ones of lines of the through-holes 212 arranged in lines. Moreover, each air direction adjustment member 292 is connected to a not-shown drive section, and is configured to rotate about one of long sides as a pivot point.

[Operation Example of Feeding Section 200C]

Next, an example of operation of the feeding section 200C in registration shift correction according to the third embodiment will be described. When a leaning detection sensor 130 detects an end portion position of sheet P after curvature correction of the sheet P, a control section 50 calculates, based on such a detection result, a leaning amount and a shift direction in a sheet width direction D2 of the sheet P. When the shift direction in registration shift correction is a device far side direction, the control section 50 rotates the air direction adjustment members 292 to the device far side such that an inclination direction of each air direction adjustment member 292 is coincident with the shift direction as illustrated in FIG. 10. That is, each air direction adjustment member 292 is adjusted to an angle θ such that the direction of air blown from each through-hole 212 of the feeding belt 210 is the shift direction.

Note that the volume of air blown from the air adjustment section 330 can be adjusted on an upper side of a feeding path R in a method similar to that for a lower side of the feeding path R.

As described above, according to the third embodiment, the registration shift direction and the air blowing direction are coincident with each other, and therefore, shift of the sheet P can be assisted. That is, air in the shift direction is blown to the sheet P so that the sheet P can be biased to the shift direction. With this configuration, registration shift correction can be reliably implemented with a high accuracy.

Fourth Embodiment

A fourth embodiment is different from the above-described first to third embodiments in that the level of the volume of air blown from a fan 240*a* and the like is changed in a sheet width direction D2. Note that other configurations, functions, and the like of an image formation device 100 are similar to those of the image formation device 100 described in the first embodiment. Thus, the same reference numerals are used to represent equivalent elements, and description thereof will not be repeated.

[Configuration Example of Feeding Section 200D]

Figure 11:
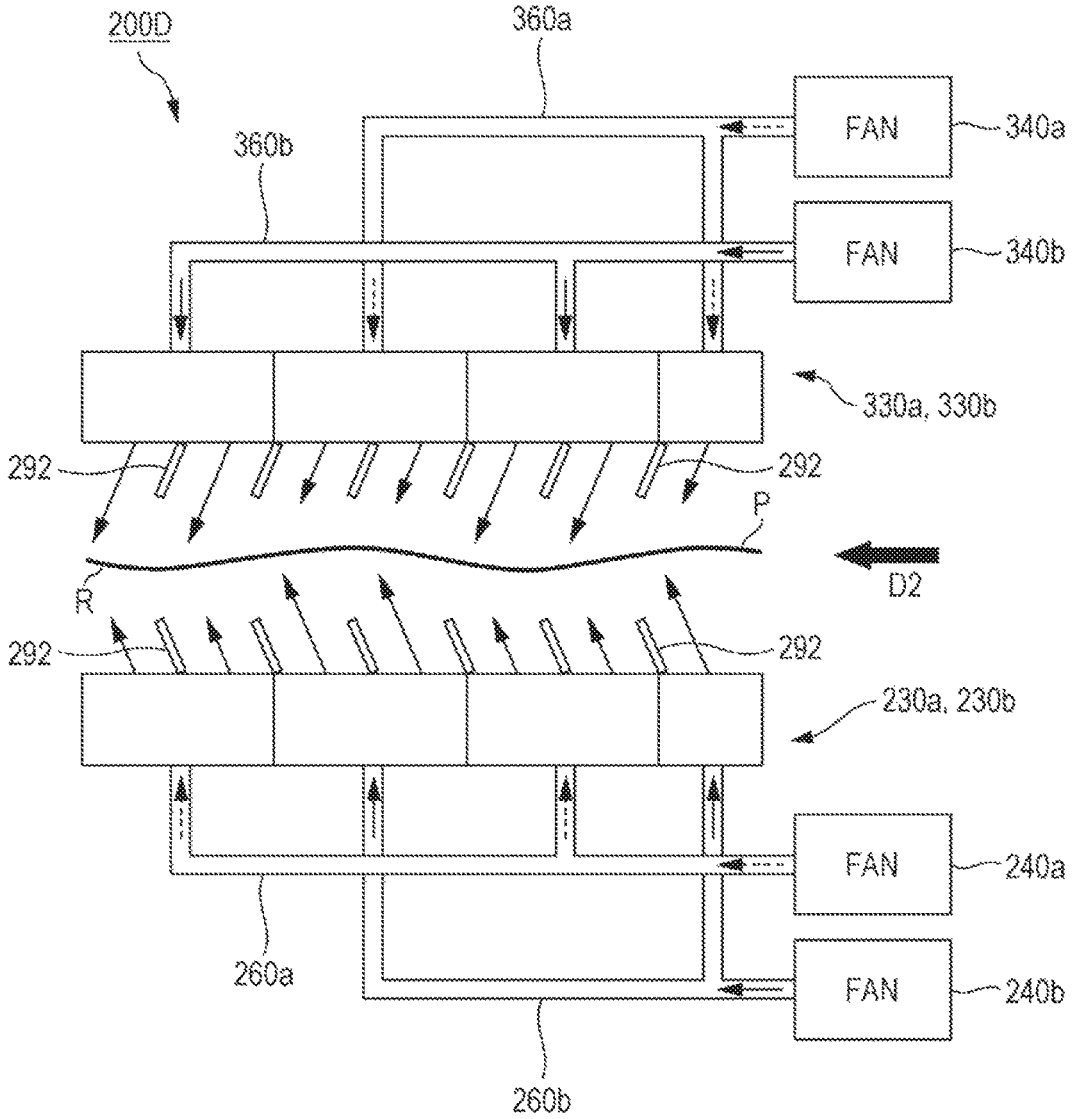
FIG. 11 is a view of a configuration example of a feeding section according to a fourth embodiment of the present invention.

FIG. 11 illustrates an example of a configuration of a feeding section 200D of the fourth embodiment. Note that as viewed in FIG. 11, the left side is referred to as a "device far side," and the right side is referred to as a "device near side." As illustrated in FIG. 11, the feeding section 200D includes air adjustment sections 230*a*, 230*b*, 330*a*, 330*b* and air direction adjustment members 292 in addition to the above-described configuration of the first embodiment.

The air adjustment section 230*a* is configured to adjust the state of air from a lower side of a feeding path R on sheet P, and includes the fan 240*a* and a duct 260*a*. The fan 240*a* includes a fan the air volume of which is adjustable, and is configured to blow air to the duct 260*a*. One end portion of the duct 260*a* is connected to the fan 240*a*, and the other end portion of the duct 260*a* is branched into two portions to extend to the inside of the feeding belt 210.

The air adjustment section 230*b* is configured to adjust the state of air from the lower side of the feeding path R on the sheet P, and includes a fan 240*b* and a duct 260*b*. The fan 240*b* includes a fan the air volume of which is adjustable, and is configured to blow air to the duct 260*b*. One end portion of the duct 260*b* is connected to the fan 240*b*, and the other end portion of the duct 260*b* is branched into two portions to extend to the inside of the feeding belt 210.

Each of the branched portions of the ducts 260*a*, 260*b* at the other end portions thereof are alternately arranged in the sheet width direction D2. That is, the ducts 260*b*, 260*a*, 260*b*, 260*a* are alternately arranged in this order from the device near side to the device far side in the sheet width direction D2.

The air adjustment section 330*a* is configured to adjust the state of air from an upper side of the feeding path R on the sheet P, and includes a fan 340*a* and a duct 360*a*. The fan 340*a* includes a fan the air volume of which is adjustable, and is configured to blow air to the duct 360*a*. One end portion of the duct 360*a* is connected to the fan 340*a*, and the other end portion of the duct 360*a* is branched into two portions to extend to above a guide member 150 (see FIG. 2).

The air adjustment section 330*b* is configured to adjust the state of air from the upper side of the feeding path R on the sheet P, and includes a fan 340*b* and a duct 360*b*. The fan 340*b* includes a fan the air volume of which is adjustable, and is configured to blow air to the duct 360*b*. One end portion of the duct 360*b* is connected to the fan 340*b*, and the other end portion of the duct 360*b* is branched into two portions to extend to above the guide member 150.

Each of the branched portions of the ducts 360*a*, 360*b* at the other end portions thereof are alternately arranged in the sheet width direction D2. That is, the ducts 360*a*, 360*b*, 360*a*, 360*b* are alternately arranged in this order from the device near side to the device far side in the sheet width direction D2.

Note that in the fourth embodiment, only air blowing at the air adjustment section 230*a* and the like has been described. However, as described in the first embodiment, an air intake mechanism can be provided in addition to an air blowing mechanism, for example.

[Operation Example of Feeding Section 200D]

Next, an example of operation of the feeding section 200D in registration shift correction according to the fourth embodiment will be described. In registration shift correction, a control section 50 sets the volume of air blown from the fan 240*a* on the lower side of the feeding path R to a first air volume, and sets the volume of air blown from the fan 240*b* to a second air volume greater than the first air volume. Of four regions divided in the sheet width direction D2 as illustrated in FIG. 11, the first and third regions from the device near side are formed such that the level of air blowing is high, and the second and fourth regions from the device near side are formed such that the level of air blowing is low.

Moreover, the control section 50 sets the volume of air blown from the fan 340*a* on the upper side of the feeding path R to a first air volume, and sets the volume of air blown from the fan 340*b* to a second air volume greater than the first air volume. Of four regions divided in the sheet width direction D2 as illustrated in FIG. 11, the second and fourth regions from the device near side are formed such that the level of air blowing is high, and the first and third regions from the device near side are formed such that the level of air blowing is low.

Further, for regions of front and back sides of the sheet P with the same phase in the sheet width direction D2, the level of the volume of blown air can be changed. Specifically, for the first regions with the same phase from the device near side, the volume of air blown from the lower side is at a high level of second air volume, and the volume of air blown from the upper side is at a low level of first air volume. Thus, for the same phase, the level of air volume is also changed.

As described above, according to the fourth embodiment, the level of the volume of air is changed in the sheet width direction D2, and therefore, the sheet P can be in a corrugated state in the sheet width direction D2. With this configuration, the sheet P can be easily moved in parallel in the shift direction. Moreover, air can easily contact a corrugated curved portion of the sheet P, and therefore, the effect of assisting shift by air can be further improved.

Note that the embodiments of the present invention have been described, but the technical scope of the present invention is not limited to the scope described in the above-described embodiments. Various changes or modifications can be made to the above-described embodiments without departing from the gist of the present invention. For example, in the above-described embodiments, the air supply fan 240 and the air intake fan 250 are configured as separate fans, but can be configured as a single fan. Moreover, the image formation device 100 illustrated in FIG. 1 is configured to form a color image, but the present invention is not limited to the image formation device configured to form a color image. The present invention is also applicable to an image formation device configured to a black-and-white image.

Although the present invention has been described and illustrated in detail, it is clearly understood that the same is by way of illustrated and example only and is not to be taken by way of limitation, the scope of the present invention being interpreted by terms of the appended claims.

What is claimed is:

1. An image formation device comprising:

a registration roller pair configured to shift a sheet in a second direction perpendicular to a first direction of a sheet feeding direction while holding the sheet;

a feeding section provided upstream of the registration roller pair in the first direction and including a feeding belt configured to convey the sheet to the registration roller pair;

a first air adjustment section configured to perform air suction or blowing for the sheet conveyed by the feeding belt; and a control section configured to switch between a first operation of controlling, when the sheet is conveyed by the feeding belt, the first air adjustment section to vacuum suck the sheet with air toward the feeding belt, and a second operation of controlling, when the sheet is swung by the registration roller pair, the first air adjustment section to provide an air cushion by blowing air on the sheet away from the feeding belt, the sheet being conveyed in the first direction during the second operation of controlling the first air adjustment section.

2. The image formation device according to claim 1, further comprising a second air adjustment section provided facing the first air adjustment section with a sheet feeding path interposed therebetween and configured to blow air on the sheet.

3. The image formation device according to claim 1, wherein the control section rotates the feeding belt in the first direction in the second operation.

4. The image formation device according to claim 1, wherein the control section determines, based on an input sheet condition, a volume of air blown from at least one of the first and second air adjustment sections in the second operation.

5. The image formation device according to claim 1, wherein the control section adjusts, based on a movement direction of the registration roller pair in the second direction, a balance of a volume of air blown from the first air adjustment section in the second operation.

6. The image formation device according to claim 2, wherein the control section adjusts, based on a movement direction of the registration roller pair in the second direction, a balance of a volume of air blown from the second air adjustment section in the second operation.

7. The image formation device according to claim 1, wherein the control section causes, in the second operation, a movement direction of the registration roller pair in the second direction to coincide with a direction of air blown from the first air adjustment section.

8. The image formation device according to claim 1, wherein the control section adjusts a level of a volume of air blown from the first air adjustment section in the second direction.

9. The image formation device according to claim 2, wherein the control section causes, in the second operation, a movement direction of the registration roller pair in the second direction to coincide with a direction of air blown from the second air adjustment section.

10. The image formation device according to claim 2, wherein the control section adjusts a level of a volume of air blown from the second air adjustment section in the second direction.

11. The image formation device according to claim 10, wherein the control section adjusts a level of a volume of air blown from the first air adjustment section and a level of a volume of air blown from the second air adjustment section for the same phase in the second direction.

12. The image formation device according to claim 1, wherein the first air adjustment section is configured to selectively perform air suction and blowing for the sheet conveyed by the feeding belt.

13. The image formation device according to claim 12, wherein the first air adjustment section is configured to blow air on the sheet conveyed by the feeding belt.

14. The image formation device according to claim 1, wherein when the sheet is swung by the registration roller pair, the sheet is moved in the second direction.

15. The image formation device according to claim 12, wherein when the sheet is swung by the registration roller pair, the sheet is moved in the second direction.

16. The image formation device according to claim 1, wherein the first air adjustment section comprises a duct and an air path switch member configured to selectively direct sucking air flow and blowing air flow to and from the feeding section through the duct.

17. The image formation device according to claim 1, wherein the first air adjustment section comprises a duct, an air supply fan to supply air to the duct, an air intake fan to intake air from the duct, and an air path switch member configured to selectively direct air flow between the feeding section and the air supply fan or the air intake fan through the duct.

* * * * *